US010301161B2

(12) United States Patent
Lux et al.

(10) Patent No.: US 10,301,161 B2
(45) Date of Patent: May 28, 2019

(54) CONTAINER-VALUE SUBASSEMBLY FOR A BEVERAGE DISPENSER AND REFRIGERATION DEVICE HAVING THE CONTAINER-VALVE SUBASSEMBLY

(71) Applicant: BSH HAUSGERAETE GMBH, Munich (DE)

(72) Inventors: Denis Lux, Heidenheim (DE); Elena Claass, Geislingen (DE); Andrea Fink, Gerstetten (DE)

(73) Assignee: BSH Hausgeraete GmbH, Munich (DE)

( * ) Notice: Subject to any disclaimer, the term of this patent is extended or adjusted under 35 U.S.C. 154(b) by 0 days.

(21) Appl. No.: 15/794,229

(22) Filed: Oct. 26, 2017

(65) Prior Publication Data

US 2018/0118548 A1 May 3, 2018

(30) Foreign Application Priority Data

Oct. 27, 2016 (DE) ..... 10 2016 221 210

(51) Int. Cl.

| | |
|---|---|
| ***B67D 1/00*** | (2006.01) |
| ***F25D 23/04*** | (2006.01) |
| ***F25D 23/12*** | (2006.01) |
| ***B67D 3/00*** | (2006.01) |
| ***B67D 3/04*** | (2006.01) |

(52) U.S. Cl.

CPC ..... *B67D 1/0082* (2013.01); *B67D 1/0004* (2013.01); *B67D 3/0009* (2013.01); *B67D 3/0025* (2013.01); *B67D 3/0035* (2013.01); *B67D 3/047* (2013.01); *F25D 23/04* (2013.01); *F25D 23/126* (2013.01); *B67D 2001/0089* (2013.01); *B67D 2210/00036* (2013.01)

(58) Field of Classification Search

CPC ..... F16K 1/16; F16K 1/18; F16K 1/20; F16K 1/2028; F16K 1/2035; F16K 2400/14; F16K 2400/36; F16K 23/12; F16K 23/123; F16K 23/126; F16K 23/025–23/026; F16K 23/028; F16K 43/00; F25D 23/126; F25D 2323/023; F25D 2400/36; B67D 3/0025; B67D 3/0038; B67D 3/044; B67D 1/0081–1/0082; B67D 2210/00041

USPC ..... 222/129, 185, 517–518, 533–537

See application file for complete search history.

(56) References Cited

U.S. PATENT DOCUMENTS 5,142,610 A * 8/1992 Augustine ..... A47J 31/54 222/146.5
5,305,927 A * 4/1994 Caveza ..... B67D 1/0425 222/185.1
5,593,067 A * 1/1997 Shaw ..... B67C 11/02 222/108

(Continued)

FOREIGN PATENT DOCUMENTS

CN 103148665 A 6/2013

*Primary Examiner* — Paul R Durand
*Assistant Examiner* — Andrew P Bainbridge
(74) *Attorney, Agent, or Firm* — Laurence A. Greenberg; Werner H. Stemer; Ralph E. Locher

(57) ABSTRACT

A container-valve subassembly for use in a refrigeration appliance contains a container and a valve which is arranged on the base of the container. At least one closing body of the valve is releasably connected to the container. The closing body is tiltable between a closed position adjacent to a valve seat and an open position about a pivotal point.

13 Claims, 8 Drawing Sheets

(56) References Cited

U.S. PATENT DOCUMENTS

| | | | | | |
|---|---|---|---|---|---|
| 5,678,737 | A * | 10/1997 | White | B67D 3/044 | 222/484 |
| 5,857,596 | A * | 1/1999 | Lee | B67D 3/0025 | 222/146.6 |
| 5,862,952 | A * | 1/1999 | Lee | B67D 3/0025 | 222/146.6 |
| 5,881,930 | A * | 3/1999 | Lee | B67D 3/0025 | 222/509 |
| 6,126,046 | A * | 10/2000 | Baculy | B67D 3/043 | 222/505 |
| 7,014,759 | B2 * | 3/2006 | Radford | C02F 1/003 | 141/330 |
| 7,077,290 | B2 * | 7/2006 | Bethuy | B67D 1/0032 | 222/129.1 |
| 7,472,807 | B1 * | 1/2009 | Black | B67D 3/0025 | 141/362 |
| 9,868,626 | B2 * | 1/2018 | Ench | B67D 3/0061 | |
| 2006/0196365 | A1 * | 9/2006 | Garman | A47J 31/10 | 99/306 |
| 2006/0243754 | A1 * | 11/2006 | Rackwitz | B65D 83/201 | 222/402.15 |
| 2009/0038330 | A1 * | 2/2009 | Lee | F25C 1/04 | 62/344 |
| 2009/0107166 | A1 * | 4/2009 | Sowers | F25C 5/24 | 62/344 |
| 2011/0259033 | A1 * | 10/2011 | Froehlich | F25C 5/22 | 62/344 |
| 2015/0239725 | A1 * | 8/2015 | Watts | B67D 3/0025 | 222/1 |
| 2016/0370104 | A1 * | 12/2016 | Yang | F25D 23/126 | |

* cited by examiner

CONTAINER-VALUE SUBASSEMBLY FOR A BEVERAGE DISPENSER AND REFRIGERATION DEVICE HAVING THE CONTAINER-VALVE SUBASSEMBLY

CROSS-REFERENCE TO RELATED APPLICATION

This application claims the benefit, under 35 U.S.C. § 119, of German patent application DE 10 2016 221 210.9, filed Oct. 27, 2016; the prior application is herewith incorporated by reference in its entirety.

BACKGROUND OF THE INVENTION

Field of the Invention

The present invention relates to a container-valve subassembly for a beverage dispenser which is capable of dispensing various beverages as well as a refrigeration appliance which contains a beverage dispenser having such a subassembly. So that a beverage dispenser may also be used for beverages other than water, it has to be possible to dismantle the subassembly to such an extent that the valve is able to be cleaned. A refrigeration appliance and a container-valve subassembly in which the container and valve are releasably screwed together are disclosed in published, Chinese patent application CN 103 148 665 A.

In this disclosed container-valve subassembly, a closing body is releasable from a valve seat by a displacement driven by a cam mechanism in order to draw off the beverage. In order to supply the beverage to an outlet which is movable with the closing body, after passing the valve seat, two telescopically interlocking sleeves are arranged downstream of the valve seat. If the movement of the closing body is not an accurate translation, there is the risk that the sleeves jam against one another and the valve is no longer tightly sealed.

SUMMARY OF THE INVENTION

An object of the present invention is to provide a container-valve subassembly which is of simple construction and which functions reliably.

The object is achieved in a container-valve subassembly for use in a refrigeration appliance, containing a container and a valve which is arranged on the base of the container. At least one closing body of the valve is releasably connected to the container, by the closing body being tiltable between a closed position adjacent to a valve seat and an open position about a pivotal point.

In particular, it may be understood by the term "pivotal point" that the closing body always comes into contact with the valve seat in the pivotal point. In other words, this means that the closing body is in contact with the valve seat in the closed position and the closing body is also in contact with the valve seat in the open position. The pivotal point, therefore, may also be understood as the contact point or contact area or point of contact or area of contact. The closing body is, in particular, movable and/or tiltable and/or pivotable about the pivotal point relative to the closing body.

The releasable connection between the closing body and the container may be ensured by an adapter portion, the closing body being movably, in particular pivotably, mounted thereon about the pivotal point and the closing body in turn being releasably connected to the container.

According to a first embodiment of the invention, the adapter portion is screwed to the base of the container. Preferably, to this end the adapter portion and the container comprise complementary threads. In order to reduce the extent of the rotation required for fastening the adapter portion, a bayonet coupling may also be provided instead of a screw thread.

According to a second embodiment, the adapter portion is displaceably guided along a base of the container by rails. In particular, a simple linear displacement of the adapter portion may be sufficient in order to anchor the adapter portion to the container or to release the adapter portion from the container. In an adapter portion guided by rails, a valve which contains parts which are offset laterally toward the valve seat may be accommodated in a space-saving manner.

The rails may comprise, in particular, grooves or tongues which extend on two parallel walls of the adapter portion and which may cooperate with complementary tongues and/or grooves on the base of the container. In other words, a tongue-groove connection may be present between the adapter portion and the container.

In particular, the valve seat may be formed in the adapter portion. Advantageously, in this case the valve seat may also be detached from the container and cleaned.

According to a simplified embodiment, the valve seat may also be part of the container.

In order to ensure a secure closing, the closing body is configured to be acted upon by a spring in the closed position.

According to one embodiment of the invention, the aforementioned pivotal point may be a point of the valve seat itself, the closing body still being in contact therewith even in the open position.

In particular, in this embodiment the valve seat may extend in an annular manner around an opening of a base plate, the closing body and a cap being able to be arranged on different sides of the base plate and being able to be connected via a connecting element extending through the opening. In order to press the closing body against the valve seat, the spring may be compressed between the cap and the base plate. The connecting element may be a pin.

In this case the base plate may be part of the adapter portion or part of the container.

In order to dismantle the valve completely and, in particular, in order to be able to expose the valve seat for cleaning, the cap and the closing body are configured to be releasably connected via the connecting element, in particular screw-connected.

An actuating portion which protrudes from the closing body in the through-flow direction of the valve may be provided for opening the valve. By the actuating portion being deflected transversely to the through-flow direction, the closing body is tilted and as a result the valve is opened. The greater the length of the lever arm of this actuating portion, the better the relationship between the force required for opening the valve and the sealing force with which the closing body is pressed against the valve seat in the closed state.

A cup-shaped element is expedient in order to collect without loss the beverage which passes through the valve and to conduct the beverage into a collecting receptacle held below the valve, the cup-shaped element being attached to the actuating portion and having an outlet opening for the beverage in the cup base.

In order to ensure that the beverage passing through the opening completely enters the cup-shaped element, a projection which extends around the valve seat and which engages in the cup-shaped element may be provided.

According to an alternative preferred embodiment, the pivotal point is formed by an axis positioned on the adapter portion.

The closing body may in this case form an arm of a two-armed lever which is pressed against the valve seat by the spring being compressed between a second arm of the lever and the base of the container.

A shaft extending along the axis may be a separate component or a component of the adapter portion; preferably it is part of the lever. In the last case the shaft may be extended out of the adapter portion and may bear at least one lever arm which is exposed outside the adapter portion, the lever being able to be actuated thereby for opening the valve.

A sleeve may be formed on the base of the container, the sleeve receiving the closing body in order to deflect downwardly a beverage passing through in the open position of the valve and passing through laterally between the valve seat and the closing body. The axis may be positioned in notches of this sleeve.

The sleeve may also receive the second arm of the lever acted upon by the spring.

In particular, the container may comprise at least one support foot which protrudes downwardly from the base below the valve. Advantageously, in this case the container may be deposited on any flat substrate, even outside the refrigeration appliance, without having to deal with the valve opening inadvertently.

In particular, the container may comprise a lid on its upper face opposing the base. Advantageously, the cleaning and refilling of the container is simplified as a result.

A further subject of the invention is a refrigeration appliance, in particular a domestic refrigeration appliance, with a thermally insulating housing which surrounds a storage compartment for refrigerated goods and comprises at least one through-opening between the storage compartment and a dispenser niche located outside the thermally insulating housing and in which a container-valve subassembly of the type described above is releasably mounted in the storage compartment, passing through the through-opening.

Preferably a control paddle is arranged on a rear wall of the dispenser niche and is coupled to the valve so that the valve is opened by pressing against the control paddle.

The coupling between the control paddle and the valve may consist in that the control paddle in turn forms an arm of a two-armed lever, the second arm thereof acting on the actuating portion or on the lever arm exposed outside the adapter portion.

Other features which are considered as characteristic for the invention are set forth in the appended claims.

Although the invention is illustrated and described herein as embodied in a container-valve subassembly for a beverage dispenser, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
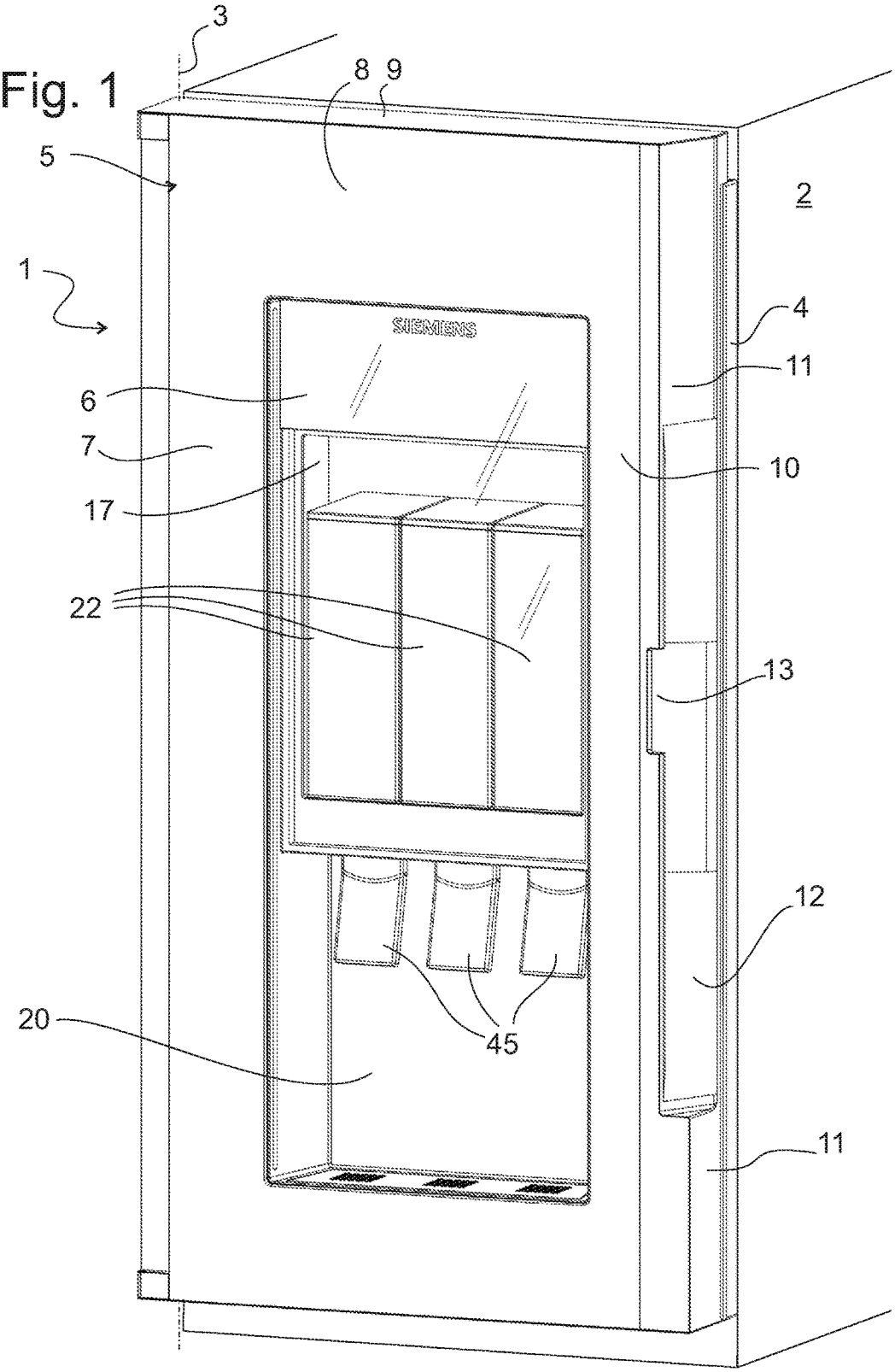
FIG. 1 is a diagrammatic, perspective external view of a door subassembly of a refrigeration appliance according to the invention.

Referring now to the figures of the drawings in detail and first, particularly to FIG. 1 thereof, there is shown a door subassembly 1 and a body 2, shown only partially, form a housing of a domestic refrigeration appliance which surrounds a storage compartment for refrigerated goods. The door subassembly 1 is pivotably articulated on the body 2 about an axis 3.

The door subassembly 1 contains a door 4 closing the storage compartment, in the narrower sense, and a cover 5 which is pivotable relative to the door 4 about the same axis 3. In the view of FIG. 1 the door 4 is substantially concealed by the cover 5.

The cover 5 contains a window pane 6 made of clear or tinted glass or plastic, in this case surrounded by a non-transparent frame 7. An upper strip of the frame 7 is L-shaped in section with a limb 8 extending vertically upward from the window pane 6 and a limb 9 angled back from an upper edge of the limb 8 toward the body 2, extending beyond an upper flank of the door 4. Correspondingly, a right-hand strip of the frame contains a limb 10 extending from the right-hand edge of the window pane 6 in the width direction of the door subassembly 1 and a limb 11 which is angled back toward the body but which is divided into two by a handle recess 12, into an upper and a lower half. A central piece 13 of the handle recess 12 extends from the edge into the limb 10.

Figure 2:
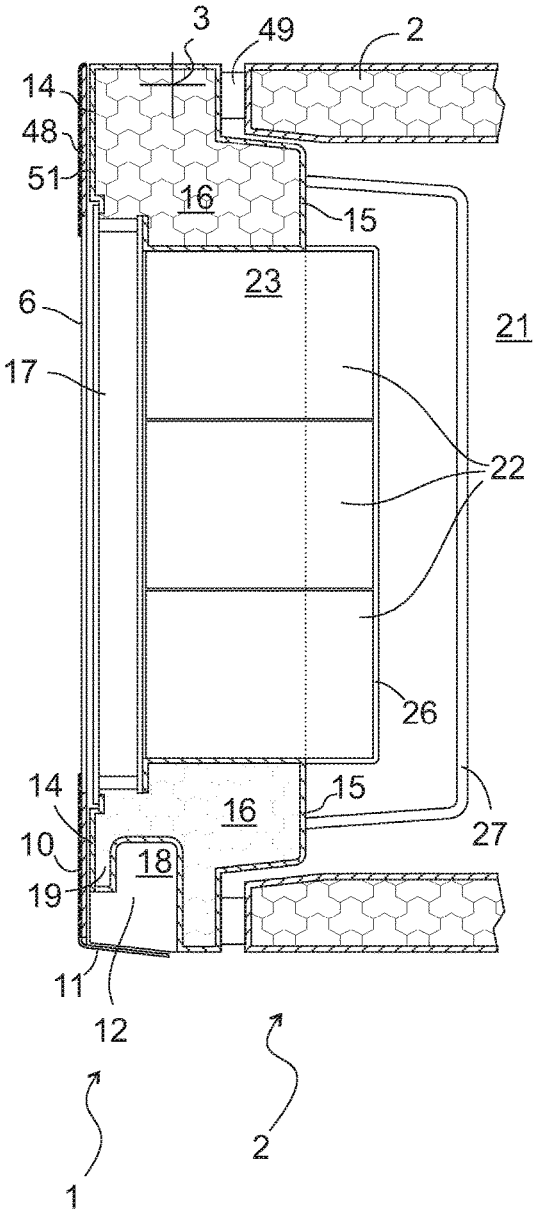
FIG. 2 is a horizontal sectional view through the door subassembly, level with the beverage containers mounted therein.

FIG. 2 shows a horizontal section through the door subassembly 1 along a plane which extends level with the handle recess 12 just above the central piece 13. In the conventional manner according to the prior art, the door 4 contains fixed external and internal walls 14, 15 which are connected along their edges in order to form a hollow space filled with thermally insulating foam 16. In this case, one respective opening is cut into the external and internal walls 14, 15, an insulating glass pane 17 being inserted therein and being sealingly connected to the walls 14, 15. A laterally open handle groove 18 is recessed in a lateral flank of the door 4. On its side facing the cover 5 the handle groove 18 is delimited by a projection 19. The limb 10 of the cover protrudes laterally over the projection 19 so that a user who grasps the handle recess 12 level with the cutting plane of FIG. 2, catches hold of the limb 10 of the cover 5 but not necessarily the projection 19 of the door 4 so that, when the limb 10 is pulled toward the user, the cover 5 but not the door 4 is pivoted about the axis 3.

Figure 3:
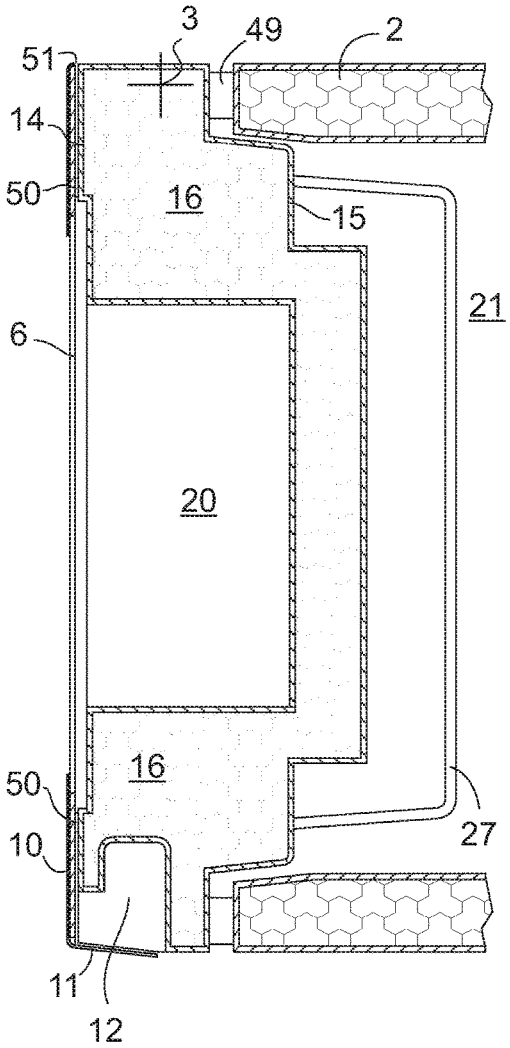
FIG. 3 is a sectional view through the door subassembly, level with a dispenser niche.

A dispenser niche 20 is accessible simply by pivoting the cover 5 about the axis 3, the dispenser niche being recessed in a lower part of the door 4 and in FIG. 3 being shown in a horizontal section through the door subassembly 1.

Level with the central piece 13, however, the edge of the limb 10 is flush with the projection 19 so that a user who grips at the level of the central piece, grasps the handle groove 18 and thus pivots the entire door subassembly 1 about the axis 3 and a storage compartment 21 for refrigerated goods in the interior of the body 2 is accessible.

FIG. 2 shows in section a plurality of beverage containers 22 which are accommodated in a niche 23 which is defined by the insulating glass pane 17 and by flanks of the internal wall 15 of the door 4 adjacent thereto and which is open toward the storage compartment 21. The beverage containers 22 fill the niche 23 in the width direction substantially without clearance. As may be identified in FIG. 1 the beverage containers 22 are visible through the insulating glass pane 17 and the window pane 6. The beverage containers may be provided with text denoting the contents thereof and visible through the panes 6, 17. Preferably, the drink containers 22 are produced from a transparent plastic so that the color and filling state of the contents thereof are visible through the panes 6, 17.

One respective control paddle 45 is mounted below each beverage container 22 in the dispenser niche 20 and in a manner described below in more detail serves to open a valve and to fill a receptacle, which is pressed against the control paddle 45 in the dispenser niche 20, with a beverage from the container 22 located above.

Figure 4:
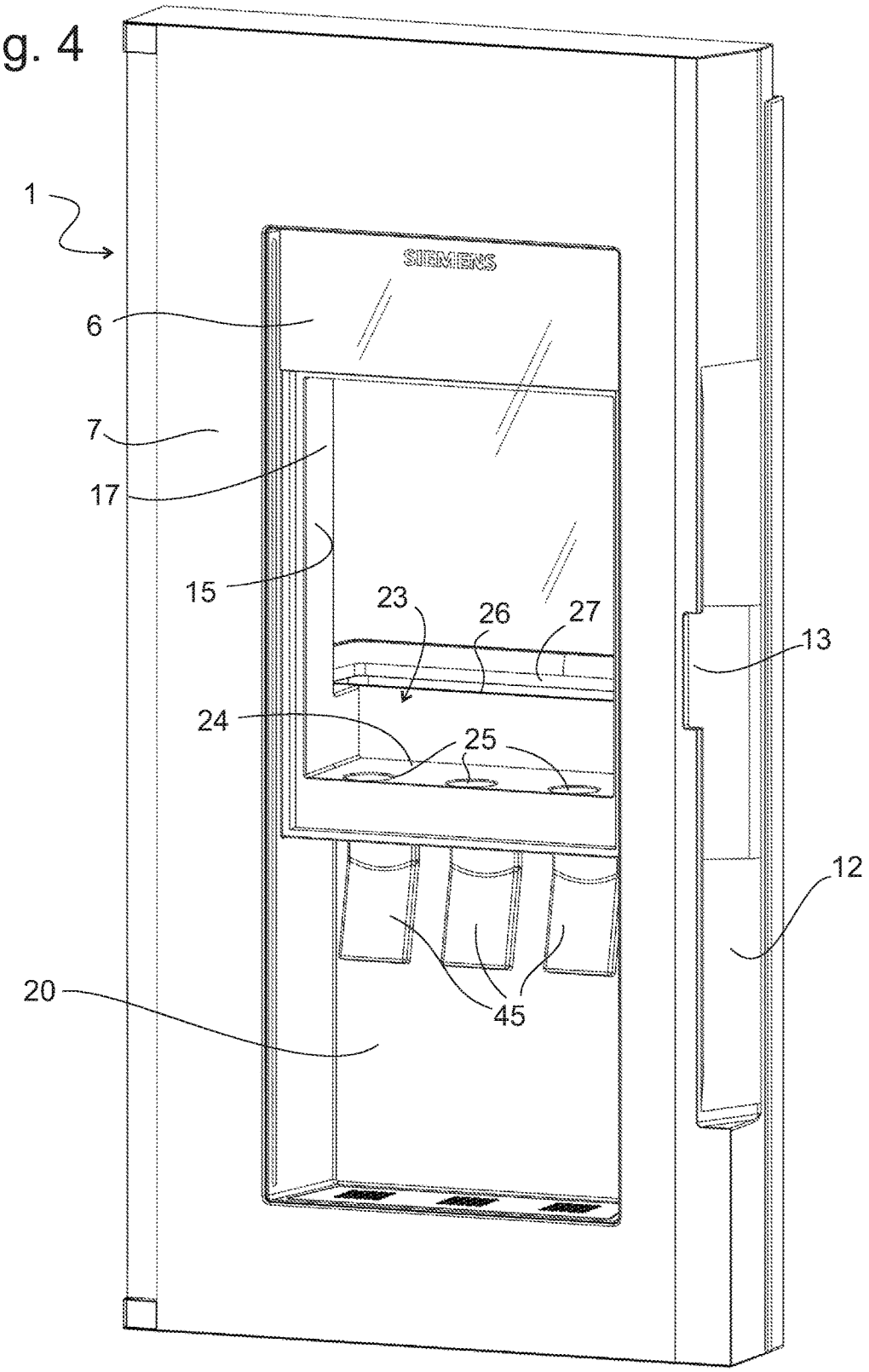
FIG. 4 is a perspective view similar to FIG. 1 of the door subassembly without the container.

FIG. 4 shows a view of the door subassembly 1 from the same perspective as FIG. 1 but without the beverage containers 22 so that a base plate 24 of the niche 23, which might otherwise be covered by the beverage containers 22, is visible through the insulating glass pane 17. For each beverage container 22 the base plate 24 has a through-opening 25 which connects the niche 23 with the dispenser niche 20 located below.

A partition 26 rises up from a rear edge of the base plate 24, the partition delimiting the niche 23 from the storage compartment 21. On the other side of the partition 26 a door shelf 27 is suspended on the internal wall 15.

Figure 5:
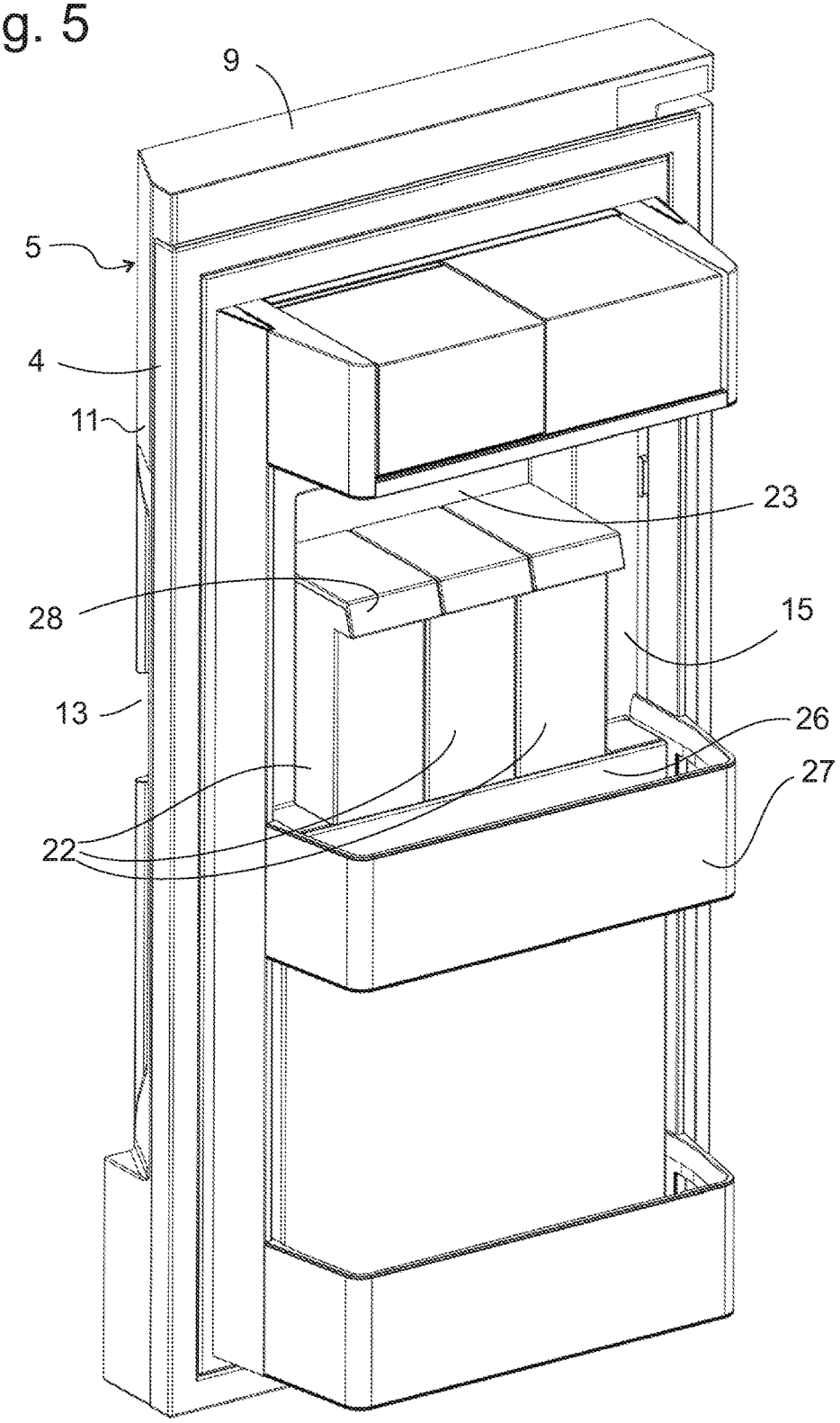
FIG. 5 is a perspective view of the door from its inner face.

FIG. 5 shows a view of the inner face of the door subassembly 1 facing the storage compartment 21. The beverage containers 22 are received in the niche 23 with sufficient clearance in the vertical direction so that they may be lifted in the niche 23, optionally tilted and removed beyond the partition 26 out of the niche 23.

In order to simplify the insertion and removal of the substantially cuboidal beverage containers 22 into and out of the niche 23, in each case the containers are provided on the rear face thereof facing the partition 26 with a grip 28, in this case in the form of a projection extending over the entire width of the beverage container 22 which is hollow on its lower face in order to permit the fingers of a user to grasp therein.

Figure 6:
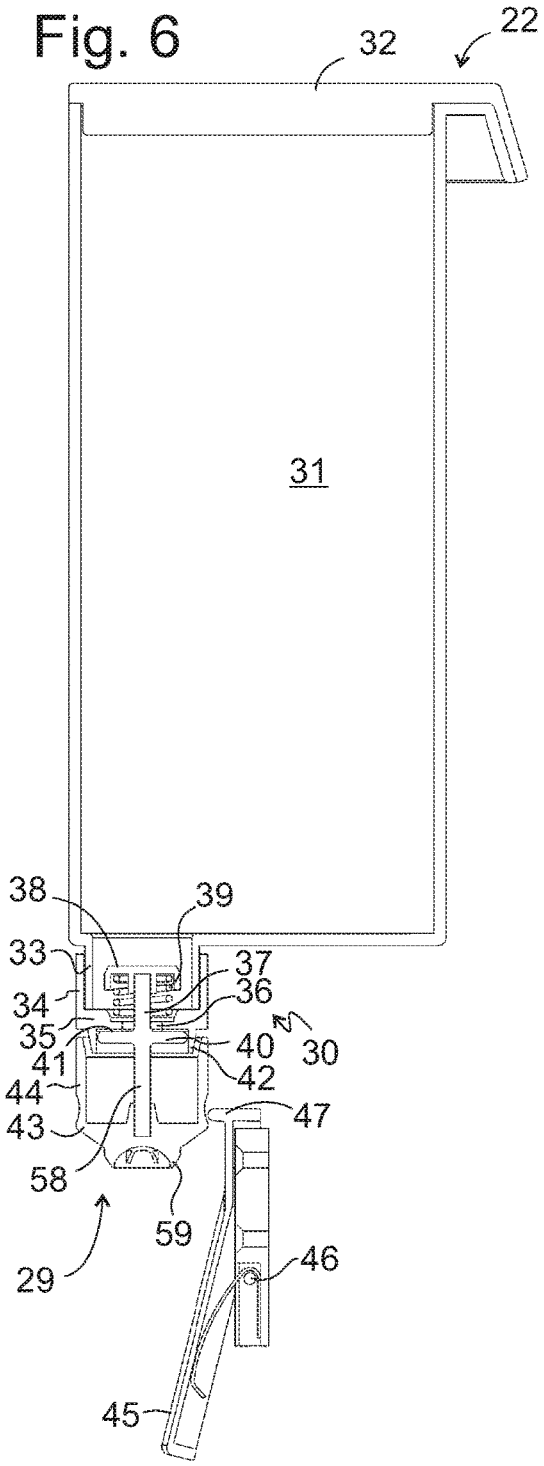
FIG. 6 is a sectional view through a container-valve subassembly.

FIG. 6 shows a vertical section through one of the beverage containers 22 and a valve 29 which is connected to the beverage container 22 to form a container-valve subassembly 30. The beverage container 22 contains a cuboidal container lower part 31 which is formed from preferably transparent plastic, the open upper face thereof being closed by a lid 32. The lid 32 in this case is sealed by a projection of the lid 32 engaging in the container lower part 31 and bearing against the inner faces of the walls thereof by a frictional connection.

An outlet pipe 33 is integrally formed on the base of the container lower part 31, the outlet pipe, when the beverage container 22 is mounted in the niche 23 and rests on the base plate 24, engaging in the through-opening 25 thereof. The outlet pipe 33 has an external thread, an adapter portion 34 of the valve 29 being screwed thereon. The diameter of the adapter portion 34 is dimensioned such that it fills the through-opening 25 over the entire cross section thereof and thus keeps the relatively warm air of the dispenser niche 20 away from the base of the container lower part 31 and thus minimizes the thermal transmission from this air to the contents of the beverage container 22.

The adapter portion 34 has a base plate 35 which covers the lower end of the outlet pipe 33 and in the screwed-on state the contents of the beverage container 22 are located on the upper face thereof. A connecting element 37 extends through a central opening 36 of the base plate 35. The connecting element in this exemplary embodiment is a pin. A cap 38 is screwed onto the upper end of the pin 37 and a helical spring 39 is resiliently compressed between the cap 38 and the upper face of the base plate 35. A circular disk-shaped closing body 40 is fastened to a central portion of the pin 37 and, by the tensioning of the helical spring 39, the closing body is held in an annular manner around the opening 36, pressed sealingly against a valve seat 41 on the lower face of the base plate 35. The valve seat 41 is surrounded in an annular manner by a projection 42 which protrudes downwardly from the base plate 35.

The lower end of the pin 37 forms an actuating portion 58, a cup-shaped element 43 being fastened to the lower end thereof. In the mounted state, the element 43 protrudes from above into the dispenser niche 20. A through-passage for the drawn-off contents of the container 22 is formed on the base of the element 43. The through-passage—optionally formed by a plurality of individual openings—is located outside the cutting plane of FIG. 6 and therefore is not visible in FIG. 6. In FIG. 6 it may be identified that a drip edge 59 is formed surrounding the through-passage. A wall 44 of the element 43 surrounding the base in an annular manner overlaps vertically with the projection 42, but does not come into contact with either the projection 42 or the base plate 35 so that it does not hinder a tilting of the closing body 40 into the open position. The diameter of the cup-shaped element 43 is not larger than that of the adapter portion 34 so that when the container 22 is empty the complete container-valve subassembly 30 may be lifted until the element 43 is located in the niche 23 and may be removed therefrom in the direction of the storage compartment 21.

Figure 7:
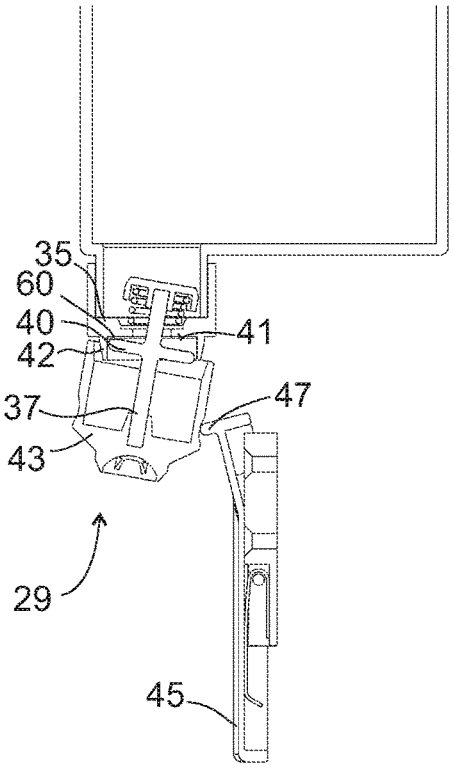
FIG. 7 is a sectional view showing the valve of the container-valve subassembly in the open position.

The control paddle 45, which is also shown in section in FIG. 6, forms an arm of a two-armed lever which is pivotable counter to the force of a restoring spring about an axis 46 perpendicular to the cutting plane. A second arm 47 of the lever is shaped and dimensioned in order to press against the cup-shaped element 43 from the lateral direction, when the control paddle 45 is deflected by a receptacle pressed there against. When the element 43 is deflected, the pin 37 tilts about a pivotal point 60 on the valve seat 41 and the closing body 40 is released from the valve seat 41, as shown in FIG. 7, on the other side of the pivotal point 60 on a part of its periphery. The valve 29 is now open. The projection 42 ensures that liquid passing therethrough is not able to escape laterally between the base plate 35 and the upper edge of the cup-shaped element 43 from the valve 29, but collects in the cup-shaped element 43 and flows into the receptacle via the through-passage thereof.

The position of the pivotal point 60 on the valve seat 41 is not fixed by the construction of the valve 29 but merely by the direction in which the element 43 is pressed to the side. Therefore, the correct functioning of the valve 29 is not dependent on how far it is screwed onto the outlet pipe 33; it functions in any orientation and, therefore, is always able to be screwed to a sufficient extent as required for a sealed connection on the outlet pipe 33.

When the empty container 22 has been removed, it may be dismantled by a few hand turns into individual parts which may be easily cleaned in a dishwasher. In particular on the valve 29 after it has been unscrewed from the container lower part 31, the cap 38 is unscrewed from the pin 37, whereupon the pin 37 together with the closing body 40 are released from the adapter portion 34 and all surfaces which have come into contact with a drink and/or liquid are exposed in order to be washed. The cup-shaped element 43 may also be unscrewed from the pin 37 in order to simplify access to the interior of the cup-shaped element 43 which is substantially closed by the closing body 40 when in use.

The through-openings 25 in the base plate 24 also unavoidably form a weak point in the thermal insulation, in comparison with the foam layer of the door 3 through which they extend, but this is of little consequence in the refrigeration appliance according to the invention, since the cover 5 prevents a free exchange of air between the dispenser niche 20 and the surroundings of the refrigeration appliance and, for this reason, when the cover 5 for access to the dispenser niche 20 is not pivoted to the side, a considerably lower temperature is present in said dispenser niche than in the surroundings.

In order to achieve a temperature difference which is as great as possible between the dispenser niche 20 and the surroundings, the cover 5 itself may be provided with a foamed thermally insulating layer 48 (see FIGS. 2, 3) and the window pane 6, corresponding to the insulating glass pane, may be configured as double glazing or multiple glazing with a thermally insulating gas filling between the glass panes. Moreover—similar to a conventional magnetic seal 49 between the door 4 and the body 1—a seal 50 may be provided which is preferably fastened to the inner face of the cover 5 and which in the closed position of the cover 5 is clamped in an annular manner around the dispenser niche 20 between the cover 5 and the door 4 and thus any air exchange between the dispenser niche 20 and the surroundings via a gap 51 between the cover 5 and the door 4 may be prevented.

Figure 8:
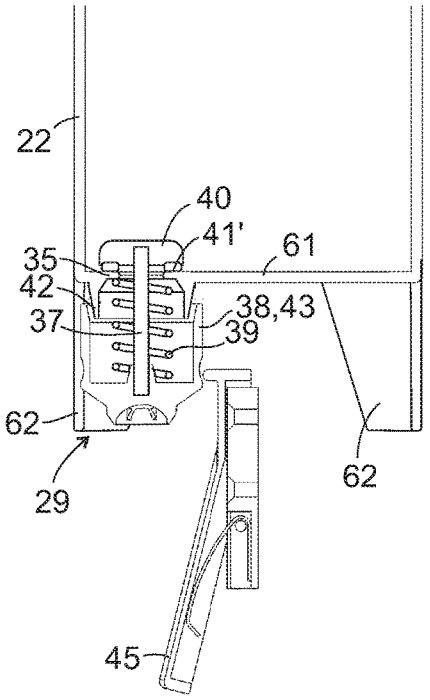
FIG. 8 is a sectional view of the container-valve subassembly with a variant of the valve.

FIG. 8 shows a cross section through the lower part of a container-valve subassembly which differs from that described above with reference to FIGS. 6 and 7 in several details which are able to be implemented independently of one another.

A first of these details is that the arrangement of the closing body 40 and the cap 38 is exchanged. The closing body 40 is located in this case on an end of the pin 37 facing the container 22; the cap 38 acted upon by the helical spring 39, however, is remote from the container so that the helical spring 39 is not continuously in contact with the contents of the container.

According to a second detail, the cap 38 and the cup-shaped element 43 are joined to form a single component.

According to a third detail, instead of the cap 38 the closing body 40 is screwed to the pin 37.

Fourth, the adapter portion 34 is dispensed with, the base plate 35 on which the valve seat 41' is located and the projection 42 engaging in the cup-shaped element 43 being in this case integral components of the container 22. Each of these features contributes to the extent to which the projection of the valve 29 downwardly from a base 61 of the container 22 may be reduced.

Fifth, a plurality of support feet 62 are integrally formed on the base 61, for example in this case in the form of L-shaped profiles arranged on the corners of the base 61. The support feet 62 protrude sufficiently far downward that the valve 29 is positioned entirely between said feet. The container 22, therefore, may be placed on a table, for example, in order to fill it from above without the valve 29 being able to open under the load of the container contents.

Figure 9:
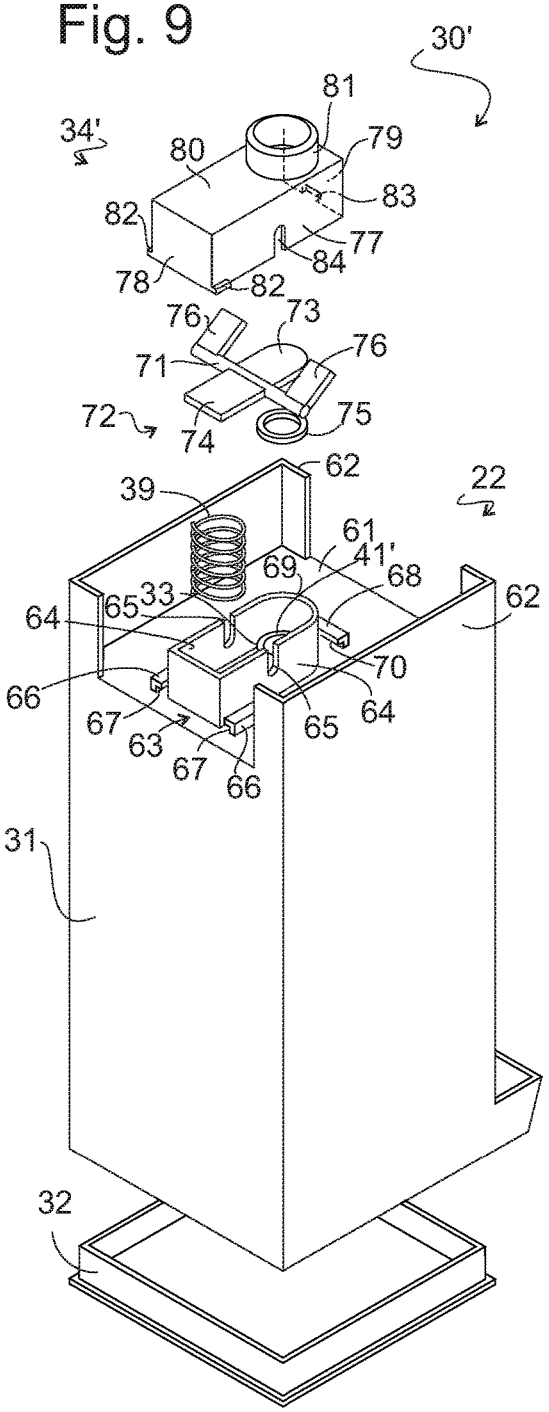
FIG. 9 is an exploded, perspective view of the container-valve subassembly according to a further embodiment.

FIG. 9 shows in an inverted and exploded view a container-valve subassembly 30' according to a second embodiment of the invention. A beverage container 22 of the subassembly 30' contains a cuboidal container lower part 31 formed from preferably transparent plastic, the open upper face thereof being closed by a lid 32. The lid 32 is sealed by a projection of the lid 32 engaging in the container lower part 31 and bearing against the inner faces of the walls thereof by a frictional connection.

A short tubular outlet pipe 33 is integrally formed on the base 61 of the container lower part 31. A lower end of the outlet pipe 33 forms a valve seat 41' of a valve 29'. Around the outlet pipe 33 extends a sleeve 63 which is also joined to the base 61 in one piece. The sleeve 63 has an elongated bottom surface. Two side walls 64 of the sleeve 63 extend parallel to one another in the longitudinal direction. In each case they have a downwardly open cutout 65.

Two ribs 66 protrude from the base 61 on both sides of the side walls. The ribs 66 have a hook-shaped cross section and together define two grooves 67 which are open toward the side walls 64 and extend in the longitudinal direction.

A third hook-shaped rib 68 is arranged transversely to the ribs 66 opposite a front wall 69 of the sleeve and defines a groove 70 which is open toward the front wall 69. The spacing between said rib and the front wall 69 is larger than that between the ribs 66 and the side walls 64 opposing said ribs.

Support feet 62 are integrally formed on the edges of the base 61. The support feet 62 could, for example, be L-shaped profiles arranged on the corners of the base 61, as mentioned with reference to FIG. 8; in the view of FIG. 9 in each case two such L-shaped profiles are joined to form a C-shaped profile.

The cutouts 65 divide the sleeve 63 into two halves, one placed toward the middle of the base 61 which receives the outlet pipe 33 and one adjacent to an edge of the base 61. The latter half provides space for a helical spring 39.

The cutouts 65 are provided in order to receive a shaft 71 of a two-armed lever 72. Two lever arms 73, 74 protrude from a central portion of the shaft 71. When the shaft 71 is placed in the cutouts 65, both lever arms 73, 74 are located inside the sleeve 63. The lever arm 73 and a sealing ring 75 mounted thereon form a closing body 40 of the valve 29'. The helical spring 39 compressed between the base 61 and the lever arm 74 holds the closing body 40 pressed against the valve seat 41'.

Two further lever arms 76 are integrally formed on the ends of the shaft 71 protruding on both sides of the sleeve 63 over the side walls 64, and which, as described in more detail below, cooperate with the control paddle 45 of the dispenser niche 20.

An adapter portion 34' ensures that the valve 29' and the container 22 are held together. The adapter portion 34' has in this case the shape of an elongated box with an open upper face, longitudinal walls 77, front walls 78, 79 and a base plate 80 in which an outlet pipe 81 is located. The box is dimensioned in order to receive the sleeve 63 with clearance in its longitudinal direction. On the longitudinal walls 77 of the box are located two short springs 82, a further spring 83 being located on the front wall 79 remote from the observer in FIG. 9. The longitudinal walls 77 in each case have a cutout 84 which is open toward the edge.

When the front wall 79 of the adapter portion 34' and the front wall 69 of the sleeve 63 come into contact with one another, the adapter portion 34' may be slipped sufficiently far over the sleeve 63 that its walls 77, 78 come into contact with the base 61. By the subsequent displacement of the adapter portion 34' in the longitudinal direction, the springs 82 spring back into the grooves 67 and the spring 83 springs back into the groove 70. Thus the adapter portion 34' is anchored on the container 22.

Figure 10:
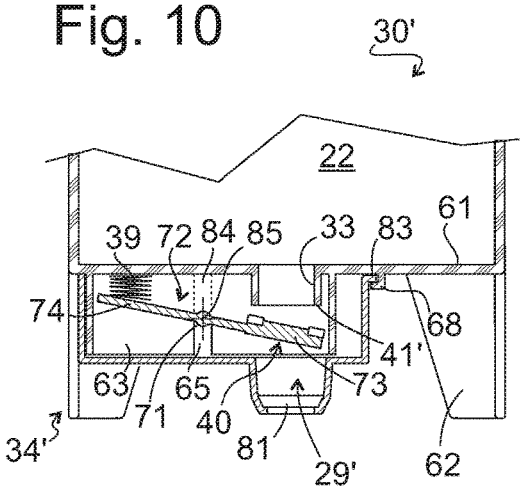
FIG. 10 is a sectional view showing the valve of the subassembly of FIG. 9.

FIG. 10 shows the lower part of the container-valve subassembly 30', in this case in the normal orientation, in a section along a plane which extends centrally between the side walls 64 of the sleeve 63 in the longitudinal direction thereof. By the cutouts 65, 84 overlapping one another, they form bearings on both sides of the lever arms 73, 74, the lever 72 being held therein pivotably about an axis 85. FIG. 10 shows the lever 72 in an open position in which the closing body 40 is spaced apart from the valve seat 41' and the helical spring 39 is highly compressed.

Figure 11:
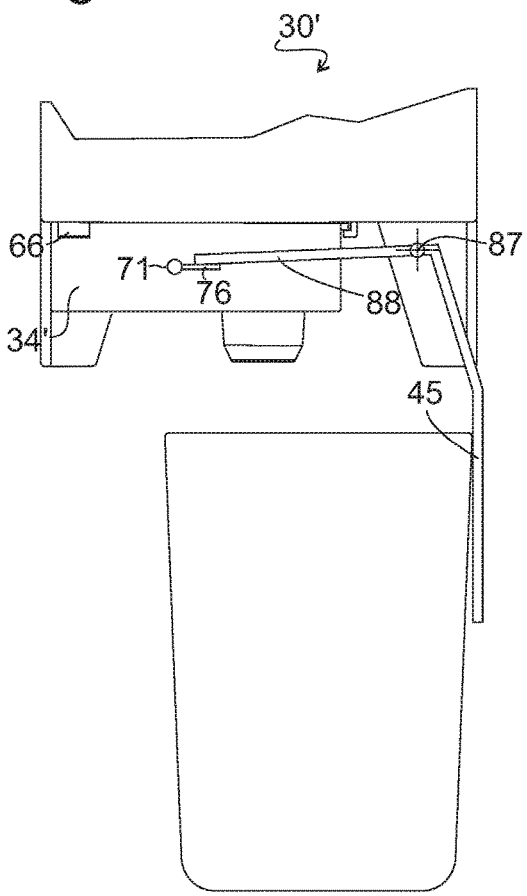
FIG. 11 is a side view of the valve.

FIG. 11 shows the container-valve subassembly 30' mounted in the refrigeration appliance in a side view, also in the open position. The control paddle 45 assigned to the subassembly 30' forms a lever arm of a two-armed lever which is pivotable about an axis 87. The second lever arm is forked into two tines 88 which enclose the adapter portion 34' on both sides. By means of a receptacle 86 pressed against the control paddle 45 in the dispenser niche 20, the lever is deflected about the axis 87 counterclockwise. As a result, the tines 88 press the lever arms 76 and hold the valve 29' open. As soon as the control paddle 45 is released, the helical spring 39 drives the valve 29' back into the closed position.

In order to dismantle and clean the valve 29', it is sufficient to displace the adapter portion 34' so that the engagement between the springs 82, 83 and 67 and 70 is released again.

Figure 12:
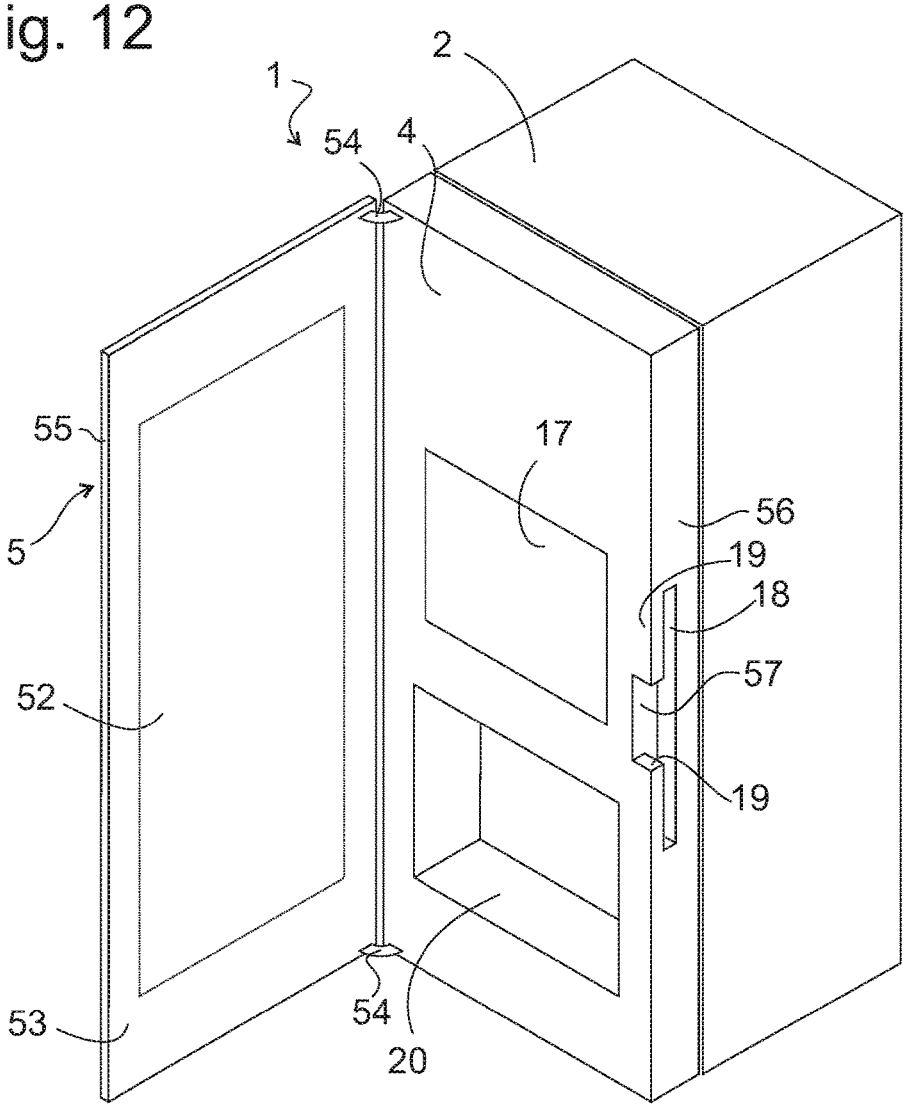
FIG. 12 is a perspective view of the refrigeration appliance with a modified cover in the open position.

In the refrigeration appliance shown in FIG. 12, as in the case of FIG. 1 the housing contains a door subassembly 1 consisting of the door 4 and cover 5 and a body 2. The cover 5 in this case is a rectangular flat plate, which is preferably made of safety glass and which in the closed position conceals the door 4. In a central region 52 the plate is transparent so that in the closed position of the cover the insulating glass pane 17 and the dispenser niche 20 are visible through the central region 52. The containers 22 of a plurality of container-valve subassemblies, as described above, are located behind the insulating glass pane. An edge region 53 may be provided with a non-transparent coating, which in the closed position, for example, conceals fittings 54 via which the cover 5 is connected to the door 4. If present, the seal 50 is bonded to the inner face of the coating of the edge region 53.

The lateral edge 55 of the cover remote from the fittings 54 in this case is linear. A handle groove 18 is formed in a flank 56 of the door 4 located behind the edge 55 in the closed position, and a projection 19 which extends between the handle groove 18 and the front face of the door 4 is interrupted in a central portion 57. If a user grips around the edge 55 level with this central portion 57, the door 4 is not grasped so that only the cover 5 is able to be opened. If, however, the user grips around the edge 55 above or below the central portion 57, the rear face of the cover 5 is not grasped, since it is concealed by the projection 19. In this case, the user is only able to grip with the fingers behind the projection 19 in the handle groove 18 and the entire door subassembly is pivoted away from the body 2.

The following is a summary list of reference numerals and the corresponding structure used in the above description of the invention:

1 Door subassembly
2 Body
3 Axis
4 Door
5 Cover
6 Window pane
7 Frame
8 Limb
9 Limb
10 Limb
11 Limb
12 Handle recess
13 Central piece
14 External wall
15 Internal wall
16 Hollow space
17 Insulating glass pane
18 Handle groove
19 Projection
20 Dispenser niche
21 Storage compartment
22 Beverage container
23 Niche
24 Base plate
25 Through-passage
26 Partition
27 Door shelf
28 Handle
29 Valve
30 Container-valve subassembly
31 Container lower part
32 Lid
33 Outlet pipe
34 Adapter portion
35 Base plate
36 Opening
37 Connecting element, pin
38 Cap
39 Helical spring
40 Closing body
41 Valve seat
42 Projection
43 Cup-shaped element
44 Wall
45 Control paddle
46 Axis
47 Arm
48 Thermally insulating layer
49 Magnetic seal
50 Seal
51 Gap
52 Central region
53 Edge region
54 Fitting
55 Edge
56 Flank
57 Central portion

58 Actuating portion
59 Drip edge
60 Pivotal point
61 Base
62 Support foot
63 Sleeve
64 Side wall
65 Cutout
66 Rib
67 Groove
68 Rib
69 Front wall
70 Groove
71 Shaft
72 Two-armed lever
73 Lever arm
74 Lever arm
75 Sealing ring
76 Lever arm
77 Longitudinal wall
78 Front wall
79 Front wall
80 Base plate
81 Outlet pipe
82 Spring
83 Spring
84 Cutout
85 Axis
86 Receptacle
87 Axis
88 Tines

The invention claimed is:

1. A container-valve subassembly for use in a refrigeration appliance, the container-valve subassembly comprising:

a container having a base;

a valve disposed on said base of said container, said valve having a valve seat and at least one closing body being releasably connected to said container, said closing body being tiltable between a closed position adjacent to said valve seat and an open position about a pivotal point, said valve further having an adapter portion and said closing body being movably mounted on said adapter portion, said closing body in turn being releasably connected to said container;

said valve additionally having a spring and said closing body being acted upon by said spring in the closed position; and said closing body forming an arm of a two-armed lever having a first arm and a second arm, said spring is compressed between said second arm of said two-armed lever and said base of said container, said two-armed lever having a shaft extending out of said adapter portion and bearing at least one additional lever arm exposed outside said adapter portion.

2. The container-valve subassembly according to claim 1, wherein said adapter portion is screwed to said base of said container or anchored by a bayonet coupling to said base.

3. The container-valve subassembly according to claim 1, wherein said adapter portion has rails for displaceably guiding said adapter portion along said base of said container.

4. The container-valve subassembly according to claim 3, wherein said adapter portion has two parallel walls and said rails are grooves or tongues extending on said two parallel walls.

5. The container-valve subassembly according to claim 1, wherein said valve seat is formed in said adapter portion.

6. The container-valve subassembly according to claim 1, wherein said valve seat is part of said container.

7. The container-valve subassembly according to claim 1, wherein the pivotal point is a point of said valve seat, and said closing body being in contact therewith in the open position.

8. The container-valve subassembly according to claim 1, wherein the pivotal point is formed by an axis positioned on said adapter portion.

9. The container-valve subassembly according to claim 1, wherein said container has at least one support foot which protrudes downwardly from said base below said valve.

10. The container-valve subassembly according to claim 1, wherein said container has a lid on an upper face opposing said base.

11. A container-valve subassembly for use in a refrigeration appliance, the container-valve subassembly comprising:

a container having a base;

a valve disposed on said base of said container, said valve having a valve seat and at least one closing body being releasably connected to said container, said closing body being tiltable between a closed position adjacent to said valve seat and an open position about a pivotal point, said valve further having an adapter portion and said closing body being movably mounted on said adapter portion, said closing body in turn being releasably connected to said container;

said valve additionally having a spring and said closing body being acted upon by said spring in the closed position;

said closing body forming an arm of a two-armed lever having a first arm and a second arm, said spring is compressed between said second arm of said two-armed lever and said base of said container; and said valve having a sleeve formed on said base of said container, said sleeve having cutouts formed therein and receiving said closing body, and an axis is also positioned in said cutouts of said sleeve.

12. A refrigeration appliance, comprising:

a dispenser niche;

a thermally insulating housing defining and surrounding a storage compartment for refrigerated goods and having at least one through-opening formed between said storage compartment and said dispenser niche disposed outside said thermally insulating housing; and a container-valve subassembly releasably mounted in said storage compartment, passing through said through-opening, said container-valve subassembly, containing:

a container having a base;

a valve disposed on said base of said container, said valve having a valve seat and at least one closing body being releasably connected to said container, said closing body being tiltable between a closed position adjacent to said valve seat and an open position about a pivotal point, said valve further having an adapter portion and said closing body being movably mounted on said adapter portion, said closing body in turn being releasably connected to said container;

said valve additionally having a spring and said closing body being acted upon by said spring in the closed position; and said closing body forming an arm of a two-armed lever having a first arm and a second arm, said spring is compressed between said second arm of said two-armed lever and said base of said container, said two-armed lever having a shaft extending out of said adapter portion and bearing at least one additional lever arm exposed outside said adapter portion.

13. The refrigeration appliance according to claim 12, further comprising a control paddle disposed on a rear wall of said dispenser niche and coupled to said valve.

* * * * *